United States Patent [19]

Chanin et al.

[11] 4,136,526

[45] Jan. 30, 1979

[54] PORTABLE HELIUM 3 CRYOSTAT

[75] Inventors: Gerald Chanin, Verrieres-le-Buisson; Jean-Pierre Torre, Herblay, both of France

[73] Assignee: Agence Nationale de Valorisation de la Recherche (ANVAR), France

[21] Appl. No.: 787,557

[22] Filed: Apr. 14, 1977

[30] Foreign Application Priority Data

Apr. 22, 1976 [FR] France ..... 76 11956

[51] Int. Cl.[2] ..... F17C 7/02

[52] U.S. Cl. ..... 62/48; 62/502; 62/514 R

[58] Field of Search ..... 62/48, 45, 52, 53, 55, 62/514 R, 502, 114

[56] References Cited

U.S. PATENT DOCUMENTS

| | | | |
|---|---|---|---|
| 3,092,972 | 6/1963 | Poorman | 62/48 X |
| 3,315,478 | 4/1967 | Walsh | 62/48 X |
| 3,620,033 | 11/1971 | Elsner | 62/55 |
| 3,863,459 | 2/1975 | Rein | 62/52 X |
| 3,967,465 | 7/1976 | Asselman | 62/48 |

*Primary Examiner*—Ronald C. Capossela

*Attorney, Agent, or Firm*—Peter K. Kontler

[57] ABSTRACT

The invention relates to apparatus maintaining extremely low and constant temperatures. The helium 3 ($He^3$) cryostat is disposed inside a portable helium 4 ($He^4$) cryostat which is constituted by a Dewar jar 2 with helium 4 at 6. The helium 3 cryostat comprises an evaporation chamber 11, a reservoir 13, an adsorption chamber 16 with an adsorbent 17, two pipes 15 and 18 and a valve 20. Particular applications in conjunction with a bolometer, the sensitive element of which is shown at 26.

7 Claims, 2 Drawing Figures

PORTABLE HELIUM 3 CRYOSTAT

The present invention relates to cryostats, i.e. apparatus which maintain extremely low and constant temperatures by means of a liquefied gas; it relates more particularly to cryostats in which the liquefied gas is helium, more precisely the isotope of helium with an atomic mass of 3 ($He^3$), whose boiling temperature at atmospheric pressure is 3.2° K. (−270° C.).

It has essentially as an object to provide a portable crysotat able to maintain for several hours an extremely low constant temperature of the order of 0.3° K. which, among other uses, enables an infra-red radiation detection bolometer to have a high detectivity.

An other object of the invention is to provide a cryostat of reduced size and weight and needing no substantial external electrical supply, and therefore adapted to be placed on board a stratosphere ballon to enable measurements of infra-red radiation to be made in excellent conditions with an associated bolometer.

Helium 3 cryostats capable of maintaining a temperature of the order of 0.3° K. are known but they are relatively bulky, heavy, technically complex and therefore fragile and require a substantial electric supply for supplying one or more pumps for reducing the helium 3 vapour tension so as to reach said temperature. Such known cryostats cannot then, for the above reasons, be put on board stratosphere ballons; they can only be used for making measurements in the laboratory and on the ground, which is a serious limitation.

A portable helium 3 cryostat according to the invention is characterized in that it comprises, disposed inside a portable helium 4 ($He^4$) cryostat of a known type, an assembly comprising a lower evaporation chamber containing in operation helium 3 in the liquid state, an upper reservoir, a first pipe interconnecting the reservoir and the evaporation chamber, an adsorption chamber containing an adsorbent which becomes effectively adsorbent for helium 3 only below a critical temperature, higher than the vaporisation temperature of helium 4, and a second pipe which connects the adsorption chamber to the first pipe, a valve being disposed in the second pipe either at the inlet or at the outlet thereof, so as to isolate the adsorption chamber from the sub-assembly formed by the reservoir, the evaporation chamber and the first pipe, said assembly, hermetically sealed, containing a gaseous mass of helium 3 under high pressure at the ambient temperature.

It will be noted that the only moving element is the valve and that there is no pump and consequently no consumption of electrical energy, unless possibly for controlling the valve.

If used with a bolometer, the sensor thereof is in thermal contact with a wall of the evaporation chamber.

The invention will be better understood from the following description in conjunction with the accompanying drawings.

Figure 1:
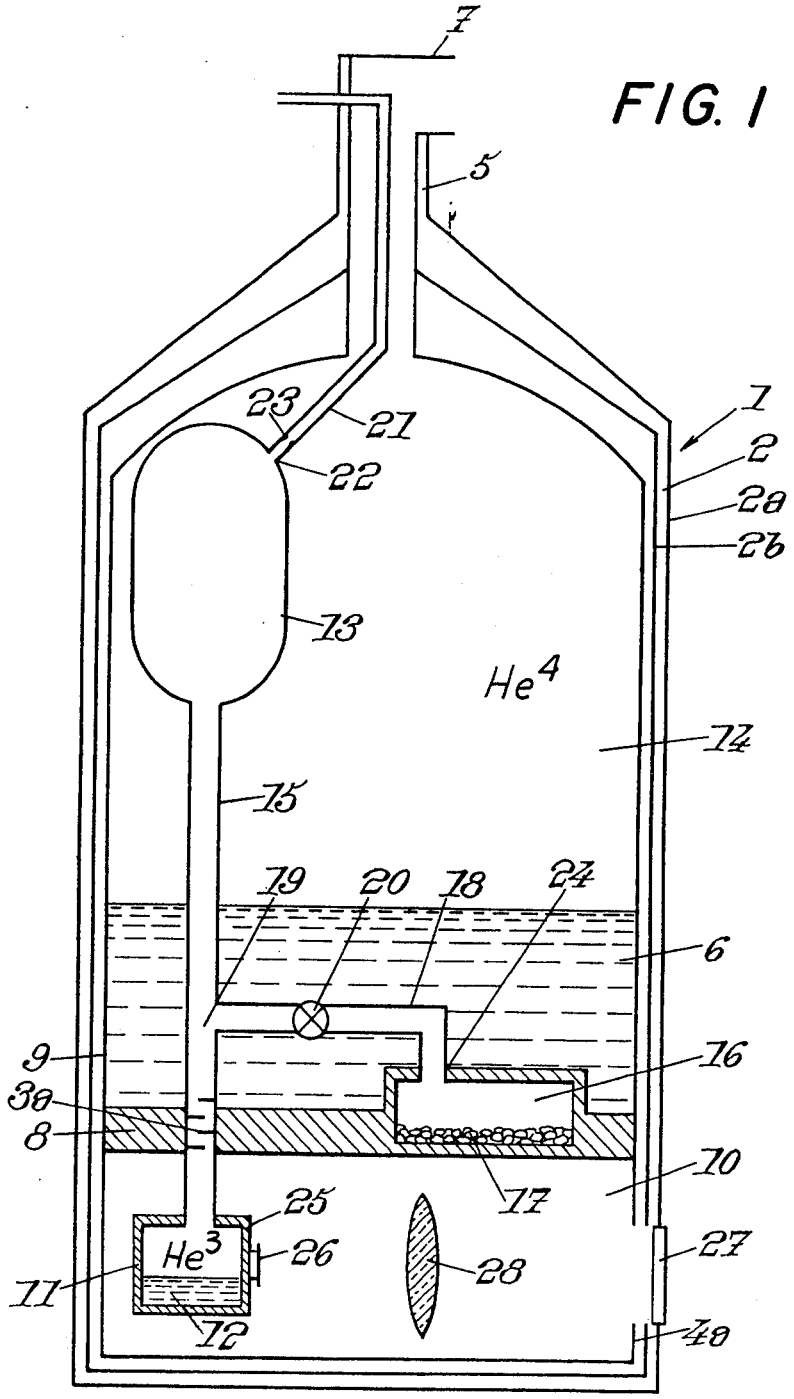
FIG. 1 is a sectional view of a portable helium 3 cryostat constructed in accordance with the invention.

According to the invention a portable helium 3 cryostat is realized as follows.

It comprises first a helium 4 portable cryostat 1 of a known type, constituted essentially by a cylindrical Dewar jar made of metal or of silvered glass (e.g. the outside wall *2a* may be of stainless steel and the thermal screen *2b* of pure aluminum) with a narrowed neck; this jar is partly filled, at 6, with liquid helium 4; a pipe 7 enables the interior 14 of the cryostat 1 to be brought to the desired pressure; on the lower part of cryostat 1 there is provided a removable metal base 8 (e.g. of stainless steel or brass) forming with the inner wall 9 (e.g. of stainless steel) a lower exhausted space 10.

In the helium 4 cryostat 1, and integral with the removable base 8, is disposed a helium 3 cryostat or, properly speaking, refrigerator. This latter comprises in combination:

a lower evaporation chamber 11 formed of a highly heat conductive metal such as electrolytic copper and containing, in operation, the liquid part 12 of helium 3 which is contained in the helium 3 cryostat, this chamber 11 is disposed in the vacuum space 10 and is surrounded by a thermal shield *4a*, of pure aluminum for example, fastened mechanically and thermally to base 8;

an upper reservoir 13 of metal housed in the space 14 above the mass 6 of liquid helium 4;

a first pipe 15, e.g. of stainless steel, connecting reservoir 13 with the evaporation chamber 11, passing through the liquid helium mass 6 and containing interiorly thermal radiation baffles *3a;* the part of pipe 15 between base 8 and evaporation chamber 11 is of low thermal conductance, e.g. of thin wall stainless steel;

an adsorption chamber 16 of small volume housed on base 8 and enclosing an adsorbing mass 17 (e.g. activated charcoal or zeolite) capable of adsorbing gaseous helium 3 only if it is at a temperature (in fact about 10° K. for activated charcoal) lower than a critical temperature higher than the boiling temperature (4.2° K.) of liquid helium 4 at atmospheric pressure;

a second pipe connecting at 19 adsorption chamber 16 with first pipe 15;

and a valve 20 disposed in the second pipe 18 (as shown) or possibly at the inlet thereof (at 19) or else at its outlet 24 so as to be able to isolate the adsorption chamber 16 (and the part of pipe 18 between this valve and chamber 16) from assembly 11, 13, 15; it is the only moving element in the helium 3 cryostat; it will be noted that the volume on the right of valve 20 (e.g. 50 ml) is much smaller than the volume on the left of this valve (e.g. 130 ml).

To fill the helium refrigerator initially with $He^3$, i.e. assembly 11, 13, 15, 16 and 18, a capillary tube 21, e.g. of copper, is provided soldered at 22 to reservoir 13. By means of this tube 21, assembly 11, 13, 15, 16 and 18 is exhausted, valve 20 being open.

The desired amount of $He^3$ (e.g. 0.2 mole) may be introduced in several ways, e.g.

(a) since the assembly is at ambient temperature, the gaseous $He^3$ is introduced under pressure through tube 21, then this tube 21 is blocked by crimping and possibly soldering at 23, near reservoir 13, thus permanently hermetically isolating the $He^3$ in the assembly 11, 13, 15, 16 and 18 from the outside, the part of tube 21 which gives to the outside being possibly cut off near the crimping 23. This operation is made simpler if base 8 is not yet fitted to the inner wall 9.

(b) the helium 4 cryostat is filled with liquid $He^4$ (6) and the charge of gaseous $He^3$ is introduced under low pressure through tube 21 which projects from the $He^4$ cryostat by neck 5. The adsorbent 17 then adsorbs the whole of the charge. The part of tube 21 projecting from the cryostat through neck 5 is then blocked by crimping and possibly by soldering. After re-heating of the assembly, base 8 can then be removed so as to crimp and possibly solder tube 21 closer to reservoir 13, thus eliminating the now useless part of tube 21. The $He^3$ is now stored permanently in assembly 11, 13, 15, 16 and 18.

In its application for maintaining an extremely low temperature for an infra-red bolometer, the cryostat of the invention comprises, an heat-conducting wall 25 of chamber 11, the sensitive element 26 of the bolometer, whereas a window 27, of quartz (or any other substance transparent to infra-red radiation) is disposed in the corresponding part of the walls of the outer cryostat 1; finally a cooled optical system (represented by lens 28) is disposed between window 27 and sensor 26 to concentrate and focus on sensor 26 the infra-red radiation passing through window 27.

The dimensions of the portable cryostat shown in the figure are, for example, the following:

diameter 17 cm;
height 46 cm;
and its weight about 7 kg which makes it easy to put it on board an aircraft for astrophysical or astonomical measurements. In particular, the output of a telescope can be focussed on sensor 26.

All the elements of the helium 3 cryostat can be integral with base 8.

The operation of the cryostat, according to the figure and which has just been described, is the following:

After closure at the ambient temperature of valve 20, the helium 4 cryostat 1 was filled with the mass 6 of helium 4 through the neck or spout 5.

At first, chamber 16 is at a temperature above 10° K. and the adsorbing mass 17 does not adsorb the helium 3 present in chamber 16 and in pipe 18 on the right of the closed valve 20. After partial filling of the cryostat 1 with helium 4, the temperature of chamber 16 drops rapidly to 10° K. and drops still further to 4° K., the boiling temperature of helium 4 at normal pressure, which is that normally provided in space 14. The pressure in chamber 16 diminishes then to tend practically to zero. On the other hand, the pressure in sub-assembly 11, 13, 15 is above 0.5 bar, for example, because of its isolation by closed valve 20 and because of the temperature of reservoir 13 above 4° K. due to its position in the upper part of space 14.

The temperature of the bath 6 of helium 4 is brought to approximately 1.5° K. by reduction of the pressure in space 14, either by pumping on the ground by use of a separable pump, or because of the rise of the carrier balloon to an altitude of about 35 km.

Because of the cooling of mass 6, the helium 3 contained in sub-assembly 11, 13, 15 condenses at the bottom of chamber 11, as shown at 12, until the $He^3$ pressure in this sub-assembly is equal to the vapour pressure of $He^3$ (of the order of 50mm of mercury) corresponding to the temperature of bath 6 of $He^4$. At that time bath 12 of $He^3$ and sensor 26 are at a temperature substantially equal to that of bath 6 of $He^4$, i.e. about 1.5° K.

It will be noted that the amount of liquefied $He^3$ at the beginning depends on the initial pressure in sub-assembly 11, 13, 15, on the temperature of bath 6 of $He^4$ and on the temperature of reservoir 13.

It is then that valve 20 is opened manually or preferably by remote control, which communicates sub-assembly 11, 13, 15 with adsorption chamber 16; the adsorbent 17, which is at a temperature of about 1.5° K., adsorbs the $He^3$ vapour of said sub-assembly and causes the $He^3$ pressure in this sub-assembly to drop rapidly. The temperature of mass 12 of the $He^3$ drops rapidly to approximately 0.3° K., which corresponds to the balance between the evaporated gaseous helium 3 and the pumping rate of this gaseous helium 3 by adsorbent 17, through pipes 18 and 15; the proximity of bath 12 and of adsorbent 17 and the very low temperature of these pipes give rise to a very high pumping rate and so to a very low temperature for mass 12. Sensor 26 is brought to this same temperature of 0.3° K. This temperature is maintained until the whole of liquid $He^3$(12) or liquid $He^4$ (6) has evaporated or until adsorbent ceases pumping because of its saturation.

It will be noted that, on opening valve 20, the temperature of bath 6 of $He^4$ can be brought to 4° K. by ceasing to reduce the pressure in space 14, which allows the separable vacuum pump to be abolished for experiments on the ground and thereby completely eliminating microphonic noise generating vibrations from the sensor. This causes a slight rise in the temperature of mass 12 of $He^3$ corresponding to the possible lowering of the pumping rate at the temperature of 4° K. of adsorbent 17.

After exhaustion of bath 6 of $He^4$, the $He^4$ cryostat 1 heats up and adsorbent 17, as soon as it reaches a temperature of 10° K., begins desorbing the $He^3$ vapour which it contains. The desorption finishes by being complete and the apparatus is back to its initial condition.

The apparatus can then be re-used after re-newing bath 6 with $He^4$. It can be seen that instead of relying on a source of electrical energy, the cryostat of the invention consumes helium 4 and possibly uses a pump on the ground to reduce the pressure of the $He^4$ in space 14.

Without special regulation of the temperature a cryostat of the invention may present the following characteristics:

autonomy (possible effective duration of use, the sensor being at an extremely low temperature and operationnaly stable) : more than 8 hours;
temperature of use 0.31° K. ± 0.02° K.;
short term fluctuation: less than 0.25° K./1000
long term drift (8 hours): 0.02° K. towards the cold.

With temperature regulation thermal drift and fluctuation can be considerably reduced.

As is evident and as that results from what precedes, the invention is in no way limited to those of its modes of application and embodiments more specially considered; it covers on the contrary all modifications.

Figure 2:
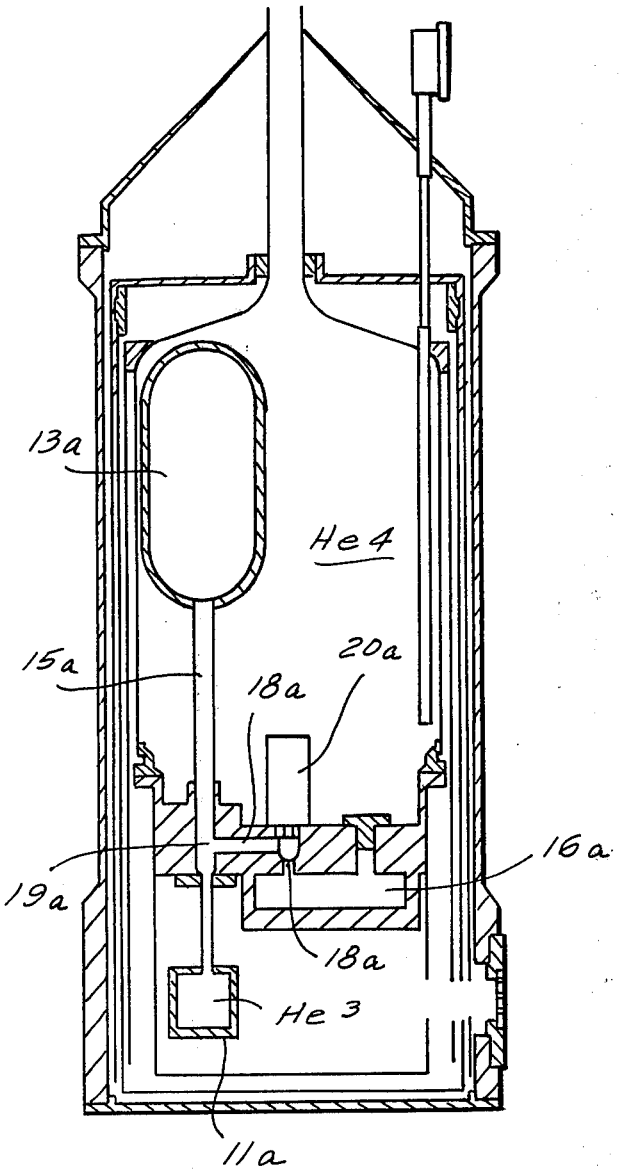
FIG. 2 is a sectional view of an alternative portable helium 3 cryostat constructed in accordance with the invention.

In particular, pipe 18, with valve 20, is incorporated in base 8 (See FIG. 2).

We claim:

1. A portable helium 3 cryostat, which comprises, disposed inside a portable helium 4 cryostat of a known type, an assembly comprising a lower evaporation chamber containing, in operation, helium 3 in the liquid state, an upper reservoir, a first pipe connecting the reservoir to the evaporation chamber, an adsorption chamber containing an adsorbent which does not become effectively adsorbent for helium 3 until below a critical temperature, higher than the vaporisation temperature of helium 4, and a second pipe which connects the adsorption chamber to the first pipe, a valve being disposed in the second pipe, either at the inlet or at the outlet thereof, for isolating the adsorption chamber from the sub-assembly formed by the reservoir, the evaporation chamber and the first pipe, said assembly, hermetically sealed, enclosing a gaseous mass of helium 3 under high pressure at the ambient temperature.

2. A cryostat according to claim 1, wherein the volume of the adsorption chamber is substantially less than that of the sub-assembly formed by the evaporation chamber, the reservoir and the first pipe.

3. A cryostat according to claim 1, wherein the helium 4 cryostat has an intermediate base which supports a liquid mass of helium 4.

4. A cryostat according to claim 3, wherein the evaporation chamber is disposed under the base, the adsorption chamber is in the base, the second pipe is in the liquid mass of helium 4 and the reservoir above said mass.

5. A cryostat according to claim 3, wherein the fact that the second pipe and the valve are incorporated in the base.

6. A cryostat according to claim 3, wherein all the elements are integral with the base which is removable.

7. A cryostat according to claim 1, wherein means for the remote control of the valve are provided.

* * * * *